United States Patent [19]

Diepeveen

[11] 3,961,762

[45] June 8, 1976

[54] WIRE DRAG UNIT

[76] Inventor: John C. Diepeveen, 1737 Kimberly Drive, Sunnyvale, Calif. 94087

[22] Filed: June 17, 1975

[21] Appl. No.: 587,753

Related U.S. Application Data

[60] Continuation of Ser. No. 471,525, May 20, 1974, abandoned, which is a continuation of Ser. No. 307,896, Nov. 20, 1972, abandoned, which is a division of Ser. No. 133,932, April 14, 1971, Pat. No. 3,709,422.

[52] U.S. Cl. ..... 242/149

[51] Int. Cl.[2] ..... B65H 59/22

[58] Field of Search ..... 242/149, 147 R, 150 R, 242/151, 152, 75.2

[56] References Cited

UNITED STATES PATENTS

| | | | |
|---|---|---|---|
| 1,319,520 | 10/1919 | Felton | 242/149 UX |
| 1,454,637 | 5/1923 | Gove | 242/149 X |
| 3,632,063 | 1/1972 | Kuehl et al. | 242/149 |
| 3,666,199 | 5/1972 | Mezzadri | 242/149 |

*Primary Examiner*—Stanley N. Gilreath

*Attorney, Agent, or Firm*—Townsend and Townsend

[57] ABSTRACT

A wire drag unit having a pair of relatively shiftable jaws. One jaw is mounted rigidly to a support and the other jaw is pivotally secured intermediate its ends to the support. The other jaw has a wire engaging a portion at one end and is provided with an L-shaped rod at the other end, the rod extending longitudinally of the jaws and provided with an adjustable weight thereon between said one end of the other jaw and the pivot point thereof.

2 Claims, 2 Drawing Figures

WIRE DRAG UNIT

Figure 1:
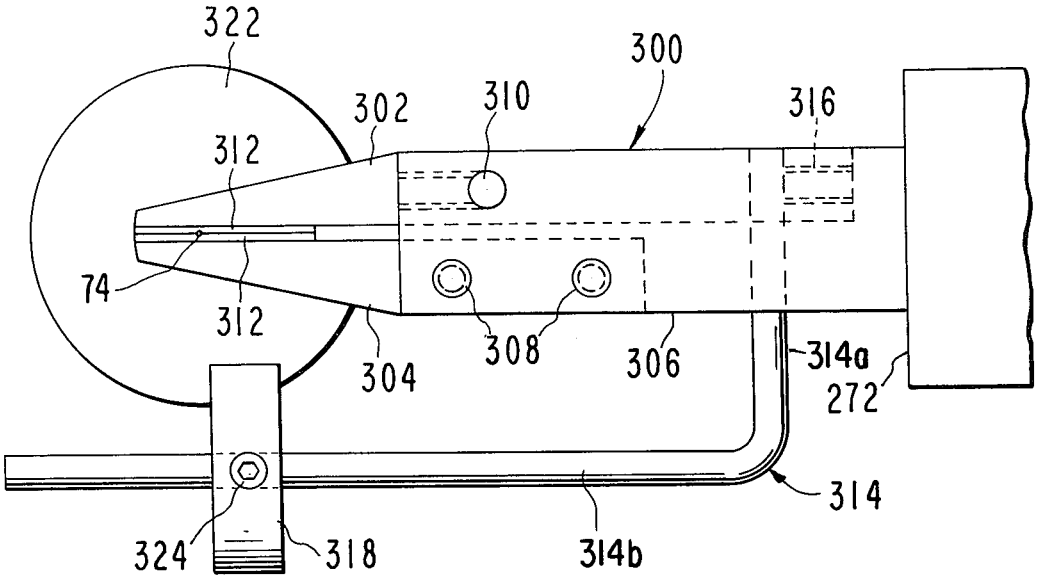

This is a continuation of application Ser. No. 471,525, filed May 20, 1974 now abandoned, which was a continuation of Ser. No. 307,896 filed Nov. 20, 1972, now abandoned, the latter application having been a division of Ser. No. 133,932 filed Apr. 14, 1971, now U.S. Pat. No. 3,709,422.

This invention relates to improvements in wire bonding machines and, more particularly, to an improved wire drag unit.

The primary object of this invention is to provide an improved wire drag unit for a wire bonding machine, wherein very lightweight forces can be adjustably applied to a wire for the tool of such a machine to prevent flattening of the wire yet to assure sufficient tension thereon as the tool moves from one point to another on a workpiece.

Other objects of this invention will become apparent as the following specification progresses, reference being had to the accompanying drawings for an illustration of the invention.

Figure 2:
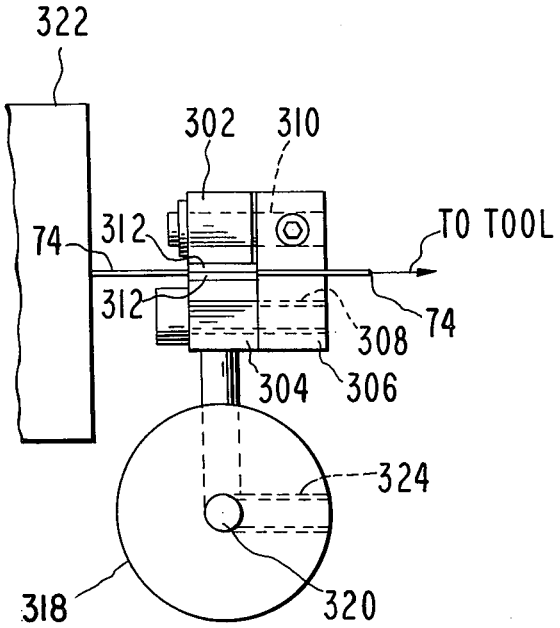

In the drawings:

FIGS. 1 and 2 are side and front elevational views, respectively, of an improved wire drag unit.

A wire drag unit 300 is shown in FIGS. 1 and 2 and is adapted to be used with a wire bonding machine to apply a drag to the wire as it is being fed toward and into a capillary of a wire bonding tool. Wire drag unit 300 includes a pair of relatively shiftable jaws 302 and 304 mounted on the wirebonding machine above the workpiece and to one side of the tool. Jaw 304 is rigidly secured to a plate-like extension 306 which, in turn, is rigidly secured to support 272 of the wire bonding machine. Screws 308 connect jaw 304 to plate 306. Jaw 302 is pivotally mounted by a pin 310 on plate 306, pin 310 being a generally horizontally disposed. The two jaws have pads 312 between which wire 74 passes, the wire being movable along a generally horizontal path as shown in FIG. 2 as it moves to the capillary of the tool. Pads 312 can be of a material suitable for cleaning the wire as it moves therebetween.

An L-shaped rod 314 is secured at one end thereof to the rear end of jaw 302 as shown in dashed lines in FIG. 1. A set screw 316 releasably connects a first segment 314*a* of rod 314 to jaw 302. A second segment 314*b* of rod 314 (FIG. 1) is below jaw 304 and is generally parallel with jaw 302. Segment 314*b* extends on both sides of the vertical plane passing through pin 310.

An adjustable weight 318 is mounted on segment 314*b* of rod 314. Weight 318 is forwardly of the vertical plane in which pin 310 is disposed. This biases jaw 302 toward jaw 304 in a counterclockwise sense when viewing FIG. 1. Thus, wire 74 between pads 312 is provided with a drag force which inhibits the movement thereof toward the tool. The wire emanates from a spool 322 on one side of unit 300.

By virtue of the foregoing construction, jaws 302 and 304 can be generally parallel with each other and the drag force exerted on the wire can be adjusted by positioning the location of weight 318 on rod segment 314*b*, the latter generally being horizontally disposed and generally parallel with the jaws. A set screw 324 releasably connects weight 318 to rod segment 314*b*.

I claim:

1. A wire drag unit for a wire bonding machine comprising: a support; a first jaw rigidly secured in a generally horizontal position to the support; an elongated second jaw; a generally horizontal pin pivotally mounting the second jaw intermediate its ends on the support and above the first jaw to permit rotational movement of one end of the second jaw toward and away from the first jaw, whereby a wire can be clamped between the jaws; a weight; and means coupled to the opposite end of the second jaw, spaced below said first jaw and extending through and beyond the vertical plane in which said pin is disposed for adjustably supporting said weight, said weight normally being on the side of said plane on which said one end of the second jaw is disposed.

2. A wire drag unit as set forth in claim 1, wherein said means includes an L-shaped rod rigidly secured to the opposite end of the second jaw, said rod having a segment substantially parallel to the second jaw.

* * * * *